US010584517B2

(12) United States Patent
Bhanpurawala et al.

(10) Patent No.: US 10,584,517 B2
(45) Date of Patent: Mar. 10, 2020

(54) LOCKING DEVICE

(71) Applicant: LOTO SAFETY PRODUCTS DMCC, Dubai (AE)

(72) Inventors: Yusufi Fakhruddin Bhanpurawala, Dubai (AE); Lai Qiyang, Dubai (AE); Qaid Zohar Zakiuddin Shahpurwala, Dubai (AE)

(73) Assignee: LOTO SAFETY PRODUCTS DMCC, Dubai (AE)

( * ) Notice: Subject to any disclaimer, the term of this patent is extended or adjusted under 35 U.S.C. 154(b) by 0 days.

(21) Appl. No.: 15/747,334

(22) PCT Filed: Oct. 12, 2017

(86) PCT No.: PCT/IB2017/056305
§ 371 (c)(1),
(2) Date: Jan. 24, 2018

(87) PCT Pub. No.: WO2019/008423
PCT Pub. Date: Jan. 10, 2019

(65) Prior Publication Data

US 2019/0010734 A1 Jan. 10, 2019

(30) Foreign Application Priority Data

Jul. 7, 2017 (IN) ..... 201741023938

(51) Int. Cl.

| | |
|---|---|
| ***E05B 67/02*** | (2006.01) |
| ***E05B 67/38*** | (2006.01) |
| ***E05B 63/14*** | (2006.01) |
| ***E05B 67/22*** | (2006.01) |
| ***E05B 17/14*** | (2006.01) |

(52) U.S. Cl.
CPC ..... *E05B 67/383* (2013.01); *E05B 17/142* (2013.01); *E05B 63/143* (2013.01); *E05B 67/02* (2013.01); *E05B 67/22* (2013.01); *E05B 2067/386* (2013.01)

(58) Field of Classification Search
CPC ..... E05B 67/383; E05B 67/143; E05B 67/02; E05B 67/00; E05B 67/22; E05B 2067/386; E05B 17/142
USPC ..... 70/14, 8, 19, 51–56, 232, 455
See application file for complete search history.

(56) References Cited

U.S. PATENT DOCUMENTS

| | | | | | |
|---|---|---|---|---|---|
| 1,369,506 | A * | 2/1921 | Voight | E05B 17/183 | 70/455 |
| 2,375,488 | A * | 5/1945 | Olson | E05B 17/002 | 277/644 |
| 2,883,849 | A * | 4/1959 | Lorenzo | E05B 17/142 | 70/427 |
| 2,904,985 | A * | 9/1959 | Murphy | E05B 17/002 | 70/38 B |

(Continued)

FOREIGN PATENT DOCUMENTS

WO WO209053496 * 3/2019

*Primary Examiner* — Suzanne L Barrett
(74) *Attorney, Agent, or Firm* — Patterson Thuente Pedersen, P.A.

(57) ABSTRACT

A locking device which multiple operators can use as a hasp lockout device to restrict access to controlled devices and areas. The locking device enables the operator to prevent unauthorized personnel from accessing the key slot of the locking device. Furthermore, the operator can employ multiple padlocks in a sequential manner so as to establish a sequence of locking or unlocking, improving workplace safety.

5 Claims, 5 Drawing Sheets

(56) References Cited

U.S. PATENT DOCUMENTS 3,714,804 A * 2/1973 French ..... E05B 17/142 70/395
3,740,981 A * 6/1973 Patriquin ..... F16B 37/14 439/142
4,218,902 A * 8/1980 Druschel ..... E05B 17/002 70/55
4,226,100 A * 10/1980 Hampton ..... E05B 17/002 70/51
4,297,861 A * 11/1981 Dykes ..... E05B 17/002 70/455
4,317,344 A * 3/1982 Barnard ..... E05B 17/002 70/55
4,884,424 A * 12/1989 Meyer ..... E05B 17/142 70/427
5,033,279 A * 7/1991 Lebrecht ..... E05B 17/002 70/55
5,156,029 A * 10/1992 Heald ..... E05B 67/02 215/321
5,524,462 A * 6/1996 Loughlin ..... E05B 67/00 292/307 R
5,582,042 A * 12/1996 Mordick ..... E05B 67/383 70/14
5,761,935 A * 6/1998 Adelmeyer ..... E05B 17/002 70/455
6,408,661 B1 * 6/2002 Chen ..... E05B 67/36 70/226
6,467,316 B1 * 10/2002 Chen ..... E05B 17/002 70/416
6,813,914 B2 * 11/2004 Chen ..... E05B 17/002 70/423
7,581,423 B2 * 9/2009 Brojanac ..... E05B 17/002 70/423
8,408,609 B2 * 4/2013 Brojanac ..... E05B 67/383 292/285
9,032,764 B2 * 5/2015 Yeh ..... E05B 65/00 70/14
9,273,490 B1 * 3/2016 McNeil ..... E05B 17/00
9,631,398 B1 * 4/2017 Liu ..... E05B 17/185
2005/0028569 A1 * 2/2005 Turek ..... E05B 67/22 70/14
2006/0042329 A1 * 3/2006 Benda ..... F16G 11/106 70/18

* cited by examiner

LOCKING DEVICE

RELATED APPLICATIONS

The present application is a National Phase entry of PCT Application No. PCT/IB2017/056305, filed Oct. 12, 2017, which claims priority from Indian Patent Application No. 201741023938, filed Jul. 7, 2017, said applications being hereby incorporated by reference herein in their entirety.

TECHNICAL FIELD

Present disclosure generally relates to a locking device. Particularly, but not exclusively the present disclosure relates to a locking device through which multiple operators can use as a hasp lockout device to restrict access to controlled devices and areas.

BACKGROUND

Existing industrial and commercial equipment are often provided with lockout devices as a standard safety measure for locking and securing hazardous energy. It is sometimes obligatory and desirable to lock equipment such as heavy electrical switch gears, fluid system components, such as valves, pressure regulators etc., to facilitate the restriction of access to the equipment in such a way that access is provided only when several people are present.

Conventionally, several of the lockout devices or group locks utilize a shackle for engagement with a hasp (or locking bracket or similar structure) and a plurality of padlock-accepting holes to prevent removal of the lockout from the hasp to allow multiple users to prevent unauthorized use of the device. In such case, each person is given a padlock and key which is different from those given to the other persons so that to gain access, everyone must be present to remove the padlocks from the lockout devices.

Further, the existing group locks do not provide any restriction for accessing the key slot of the padlocks, therefore the padlocks are susceptible to be tampered. Also, the existing group locks do not provide any arrangement of sequential locking or unlocking of the padlocks. Therefore, it is feasible to establish a sequence of locking or unlocking, thereby improving workplace safety.

The present disclosure is directed to overcome one or more limitations of the prior art devices.

SUMMARY

One or more shortcomings of the prior art are overcome by an assembly as claimed and additional advantages are provided through the provision of a mechanism as claimed in the present disclosure.

In one non-limiting embodiment of the present disclosure a locking device, comprising a body having an inner chamber, a locking mechanism configured within the inner chamber of the body wherein a key slot of the locking mechanism is exposed at a bottom surface of the body, a shackle comprising a heel portion moveably secured with the locking mechanism and a toe portion wherein the shackle is movable between an unlocked position and a locked position, and a cover being rotatably mounted on the bottom surface of the body, wherein the cover is rotatable between a first position and a second position wherein in the first position, the cover is adapted to close the exposed key slot to prevent access of the key slot, and in the second position, the cover is adapted to expose the key slot. The cover and body are provisioned to secure the cover in the first position by means of a secondary locking device thereby preventing the rotation of the cover from the first position to the second position.

In an embodiment, the locking mechanism is configured to lock the toe portion of the shackle in the locked position. In an embodiment, the plurality of flanges extend laterally outwardly from the body and each of the flanges has a hole. In an embodiment, the cover comprises a plurality of holes alignable with holes of the flanges of the body in the first position of the cover. The aligned holes are adapted to receive the secondary locking device to secure the cover in the first position. In an embodiment, the secondary locking device is a pad lock.

In an embodiment, the cover is rotatably mounted on the bottom surface of the body by means of a pivot pin. The cover comprises multiple portions and each of the portions is adapted to rotate relative to the other portion of the cover.

In an embodiment, the locking device further comprises a pair of protective seals connected by a flexible strip positioned on the top surface such that the seal secures the heel portion of the shackle and the seal is engageable with the toe portion of the shackle wherein the protective seals ensures an effective seal against dust, humidity, moisture and other foreign materials ensuring entering of the same into the body of the locking device.

In an embodiment, the protective seal has a tubular wall portion with a central circular opening, such that the tubular wall portions of the seal include a vertical slit and the seal is positioned over the provision to removably receive the toe portion of the shackle to permit locking or unlocking of the toe portion of the shackle with the locking mechanism.

In an embodiment, a locking device comprises a body having an inner chamber, a locking mechanism configured within the inner chamber of the body wherein a key slot of the locking mechanism is exposed at bottom surface of the body, a shackle comprising a heal portion moveably secured with the locking mechanism and a toe portion wherein the shackle is movable between an unlocked position and a locked position and a cover being slidably mounted on the bottom surface of the body, wherein the cover is slidable between a first position and a second position wherein in the first position, the cover is adapted to close the exposed key slot to prevent access of the key slot and in the second position, the cover is adapted to expose the key slot. The cover and body are provisioned to secure the cover in the first position by means of a secondary locking device thereby preventing the rotation of the cover from the first position to the second position.

Additional features and advantages are realized through the techniques of the present disclosure. Other embodiments and aspects of the disclosure are described in detail herein and are considered a part of the claimed disclosure.

BRIEF DESCRIPTION OF THE ACCOMPANYING DRAWINGS

The novel features and characteristic of the disclosure are set forth in the appended claims. The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which:

Figure 1:
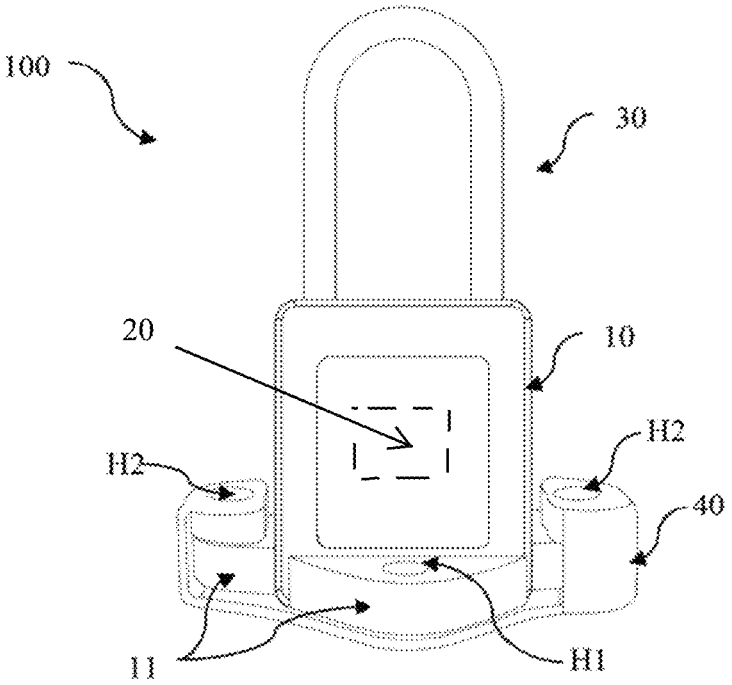
FIG. 1 is a front view of the locking device according to an embodiment of the present disclosure, with the locking mechanism schematically depicted by phantom lines.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the forms disclosed, but on the contrary, the disclosure is to cover all modifications, equivalents, and alternatives falling within the spirit and the scope of the disclosure.

The terms "comprises", "comprising", or any other variations thereof, are intended to cover a non-exclusive inclusion, such that a setup, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or apparatus.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

The present disclosure relates to a locking device, comprising a body, a locking mechanism, a shackle, and a cover. The body has an inner chamber into which a locking mechanism is positioned such that a key slot of the locking mechanism is exposed at the bottom of the body. The shackle has a heel portion disposed within the body and mechanically connected to the locking mechanism and a toe portion movable between a locked position and an unlocked position. The body further comprises a plurality of flanges extending laterally outwardly from the body. The flanges include a plurality of holes H1. The cover is rotatably mounted on the bottom of the body, wherein the cover is rotatable between a first position and a second position. The cover includes a plurality of holes H2 alignable with the holes H1 of the flanges. When the cover is in the first position, the key slot of the locking mechanism is closed and the plurality of apertures on the cover are aligned with the holes of the flanges. In the first position of the cover, the key slot is closed and thus provides restriction for accessing the key slot of the locking mechanism. Also, as the holes H1, H2 of the flange and the body are aligned, the cover can be secured with the body by inserting one or more secondary locking devices through the holes H1 and H2. Thus, locking the cover in the first position and prevents its rotation from the first to the second position.

When the cover is in the second position, the key slot is open such that a plurality of apertures on the said cover misalign with the said plurality of apertured flanges. In the second position of the cover, the key slot is open and thus provides access to the key slot of the locking mechanism. The locking mechanism is operated by inserting a key into the key slot and rotating the key clockwise/anti-clockwise to lock or unlock the heel of the shackle from the locking mechanism.

The following paragraphs describe the present disclosure with reference to FIGS. 1 to 6. In the figures, the same element or elements which have similar functions are indicated by the same reference signs.

FIGS. 1 to 4 of the present disclosure illustrate a locking device 100. The locking device 100 comprises of a body 10, a locking mechanism 20, a shackle 30, and a cover 40.

Figure 2:
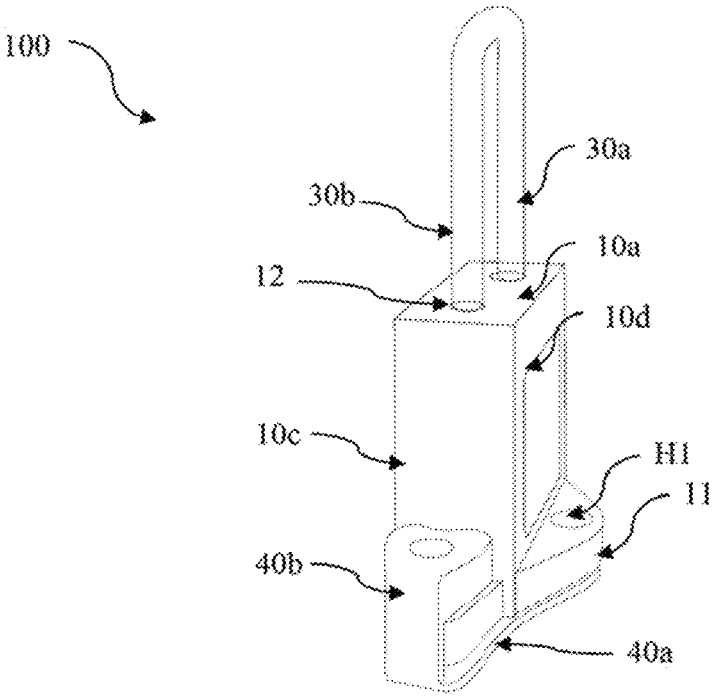
FIG. 2 is a side view of the locking device of FIG. 1 with the cover operating in first position.

As depicted in FIGS. 1 and 2, the body 10 comprises of a top surface 10*a*, a bottom surface 10*b*, a pair of side surfaces 10*c*, a front surface 10*d*, and a back surface 10*e* that define an inner chamber. The body 10 may be configured in any shape, and is employed for the purpose of fixing and rigidly supporting a locking mechanism within the inner chamber of the body 10. The body 10 further includes a plurality of flanges 11 extending laterally outwardly from the body. The body 10 may be constructed of steel, hard plastic, or any other suitably durable material.

The locking mechanism (not shown in the figures) can be any known mechanism, for example, a padlock, a cylindrical lock, a dial combination lock etc., which includes a locking mechanism of any known type. The locking mechanism is fixed to an inner chamber of the body 10. The locking device comprises a shackle having a heel portion 30*a* disposed within the body and moveably connected to the locking mechanism and a toe portion 30*b* movable between a locked position and an unlocked position. The shackle 30 extends upwardly from top surface 10*a* of the body 20. A provision 12 is positioned within the body 10 to removably receive the toe portion 30*b* of the shackle 30 for the purpose of locking or unlocking the toe portion of the shackle 30 with the locking mechanism 20. The locking mechanism is configured to lock the toe portion of the shackle in the locked position.

Figure 3:
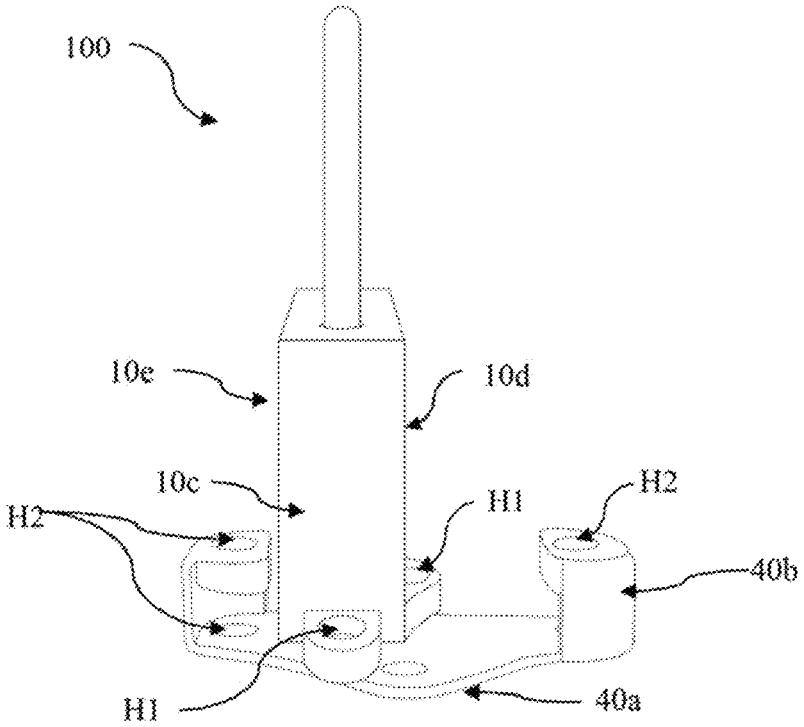
FIG. 3 is a side view of the locking device of FIG. 1 with the cover operating in second position.
Figure 4:
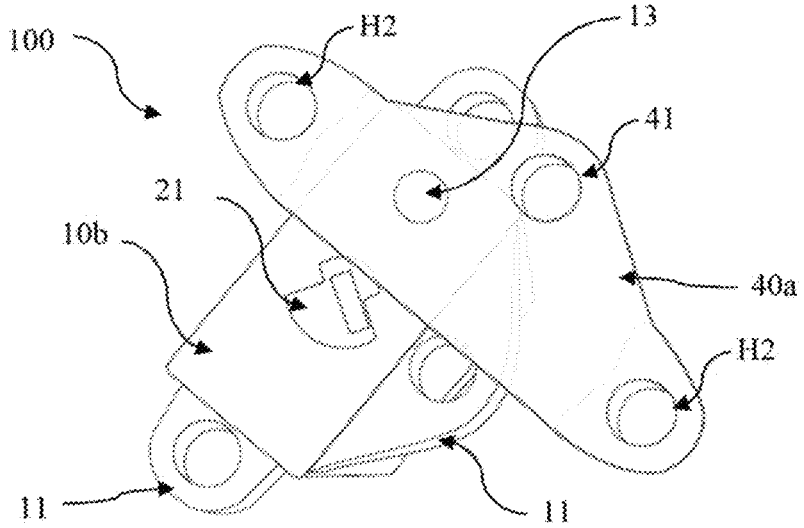
FIG. 4 is a bottom view of the locking device of FIG. 1 with the cover operating in second position.

In an embodiment as shown in FIGS. 3 and 4, the body 10 has an opening at the bottom surface 10*b* to expose a key slot 21 of the locking mechanism. The locking mechanism is operable by inserting a suitable key in the key slot 21 and by rotating the key clockwise/anti-clockwise, to lock or unlock the toe portion of the shackle 30 with the locking mechanism. The toe portion of the locking mechanism is adapted to cooperate with the locking mechanism for locking/unlocking by the operation of the key inserted in the key slot.

The cover 40 is rotatably received on the body 10 at a pivot point 13 on the bottom surface 10*b*. The cover 40 may comprise a flat body having a flat horizontally oriented portion 40*a*, defining a plurality of lip portions 40*b* at the end of the flat horizontally oriented portion 40*a*. The lip portion 40*b* integrally houses the plurality of apertured flanges 11. The flanges 11 comprise plurality of holes H1. The cover 40 includes a plurality of holes H2 alignable with the holes H1 of the flanges 11. The cover 40 is rotatable about the pivot point 13 between a first operating position and a second operating position. When the cover is in the first operating position, the key slot 21 of the locking mechanism 20 is closed by the cover and the plurality of holes H2 on the cover 40 are aligned with the holes H1 of the flanges 21. In the first operating position of the cover 40, the key slot 21 is closed and thus prevents access of the key slot 21 of the locking mechanism. When the cover 40 is in the second operating position, the key slot 21 is open and the plurality of holes H2 on the cover 40 misalign with the holes H2 of the flanges 11. In the second position of the cover, the key slot 21 is open and thus provides access to the key slot 21 for operating the locking mechanism 20. The cover 40 can made of metal, plastic, or any other suitable material.

In an embodiment of the disclosure, the cover 40 comprises multiple portions, thereby allowing an outward pivoting or rotation of each portion of the cover about at least one pivot point.

In another embodiment of the present disclosure, the cover 40 may be slidably mounted on the body instead of being rotatable about the pivot point so that the cover is slidably moveable between a first operating position to a second operating position and vice-versa. In an embodiment of the disclosure, the cover 40 may be substantially a flat member without any lip portion. In another embodiment, the cover 40 may be hinge mounted on the body 10. Also, the cover 40 and the body 10 can be configured with any suitable design to perform required operations.

The following paragraph(s) describe the operation of the locking device 100 according to an embodiment.

Figure 5:
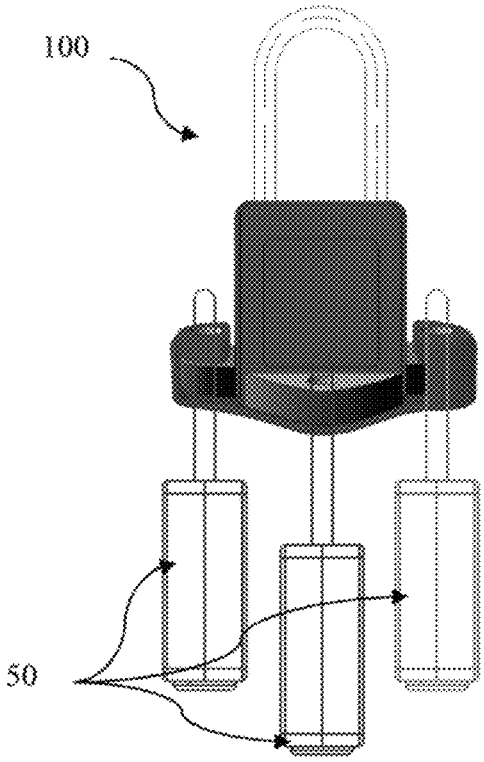
FIG. 5 is a perspective view of the locking device of FIG. 1 with a secondary locking device inserted in the plurality of holes aligned with holes of the flange.

The locking device 100 can be used for the purpose of locking any industrial and commercial equipment. Similar to the usage of a conventional lock, the equipment can be retained in a desired condition by inserting a shackle 30 of the locking device 100 in a looped configuration with the equipment such that the toe portion 30*b* is positioned into the provision 12 within the body 10. At this instance, the cover 40 is in the second position, wherein the key slot 21 is open and thus provides access to the key slot 21 for operating the locking mechanism 20. A suitable key can be inserted into the key slot 21 and rotated clockwise/anti-clockwise to lock the shackle 30 with the locking mechanism and to secure the equipment. Further, the cover 40 is rotated to the first position, wherein the key slot 21 is closed and thus provides restriction for accessing the key slot 21 of the locking mechanism 20. When the cover 40 is in the first operating position the plurality of holes H1 on the cover 40 get aligned with the holes H1 of the flanges 21. As shown in FIG. 5, the aligned plurality of holes H1, H2 can be secured by at least one padlock or any other secondary locking device 50 such that the cover 40 cannot be rotated and to keep the key slot 21 inaccessible. Thus, the operator can prevent others from accessing the key slot 21 of the locking device 100. More than one padlock can be used for locking the cover with the body to ensure multilevel approval for unlocking the cover from the body and for unlocking the locking device.

Figure 6:
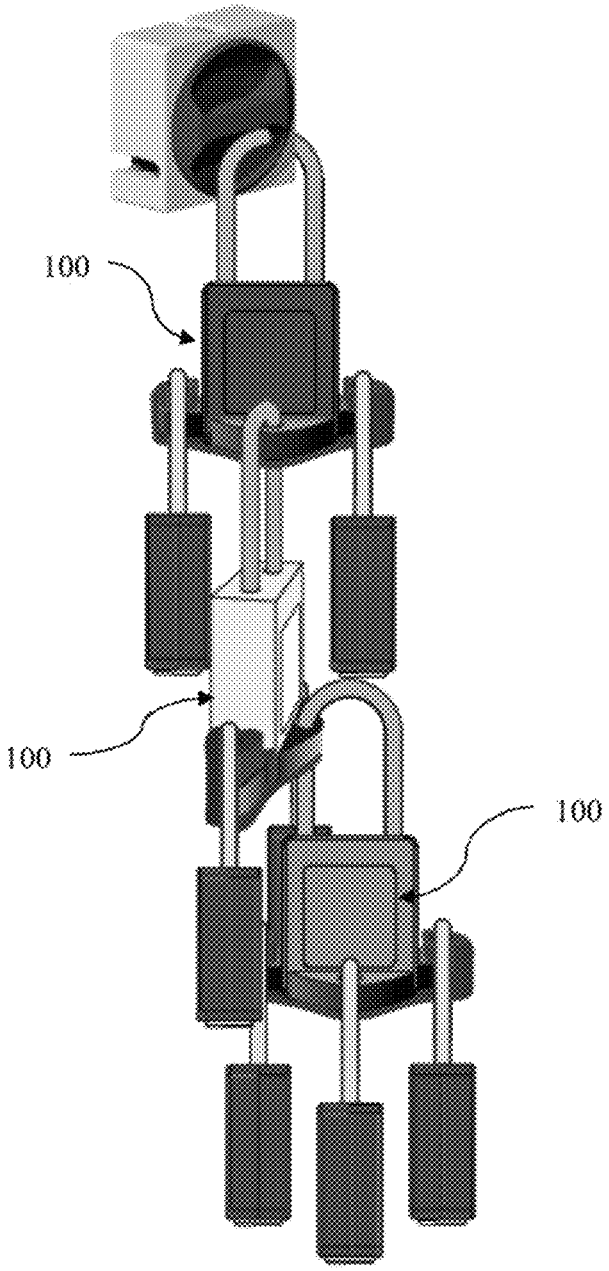
FIG. 6 is a perspective view of the locking device of FIG. 1 with a secondary locking device inserted in the plurality of holes aligned with holes of the flange forming a sequential lock.

Furthermore, the operator can employ multiple padlocks in a sequential manner as shown in FIG. 6 to establish a sequence of locking or unlocking, improving workplace safety.

The locking device 100 can be unlocked by first removing the padlock or any other locking device secured to the aligned plurality of holes H1, H2. Consequently, the cover 40 will be free to rotate and the cover 40 can be rotated from the first operating position to the second operating position such that access to the key slot 21 for operating the locking mechanism 20 is provided. Finally, a suitable key can be inserted into the key slot 21 and rotated clockwise/anti-clockwise to unlock the shackle 30 with the locking mechanism 20 and to unlock the equipment.

In an embodiment, the locking device 100, comprising a body 10 having an inner chamber a locking mechanism 20 configured within the inner chamber of the body 10 wherein a key slot 21 of the locking mechanism is exposed at the bottom surface 10*b* of the body 10, a shackle 30 comprising a heel portion 30*a* moveably secured with the locking mechanism, and a toe portion 30*b* wherein the shackle is movable between an unlocked position and a locked position, and a cover 40 being slidably mounted on the bottom surface of the body 10, wherein the cover 40 is slidable between a first position and a second position wherein in the first position, the cover 40 is adapted to close the exposed key slot 21 to prevent access to the key slot 21 and in the second position, the cover 40 is adapted to expose the key slot 21. The cover 40 and body 10 are arranged to secure the cover 40 in the first position by means of a secondary locking device 50 thereby preventing the rotation of the cover 40 from the first position to the second position. In an embodiment of the disclosure, the cover 40 comprises multiple portions, thereby allowing an outward sliding of each portion of the cover 40.

Figure 7:
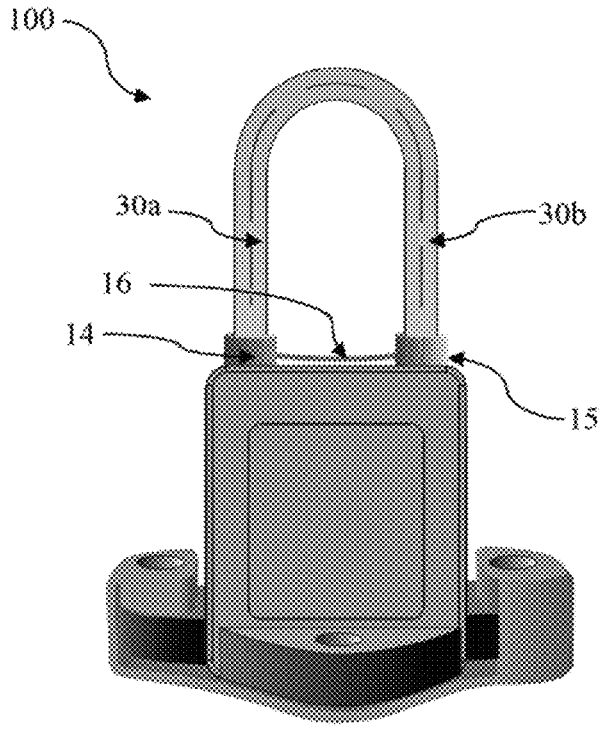
FIG. 7 is a perspective view of the locking device comprising protective seals.
Figure 8:
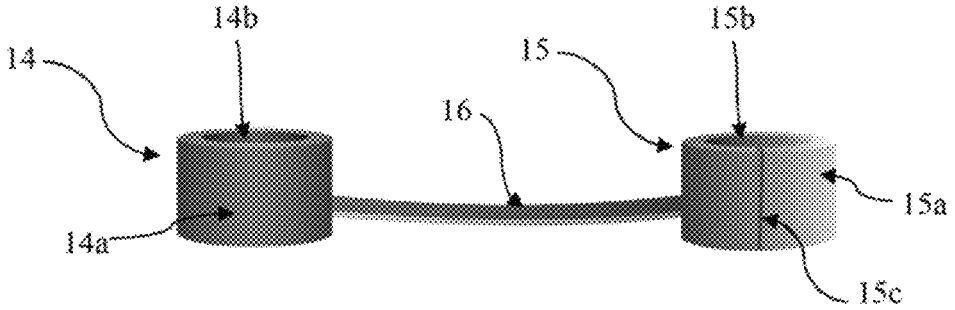
FIG. 8 is a perspective view of protective seals connected by a flexible strip.

In an embodiment as shown in FIG. 7 and FIG. 8, the locking device 100 comprises a pair of protective seals 14, 15 connected by a flexible strip 16 positioned on the top surface 10*a* such that the seal 14 secures the heel portion 30*a* of the shackle 30 and the seal 15 is engageable with the toe portion 30*b* of the shackle 30. Each protective seal 14, 15 has a tubular wall portion 14*a*, 15*a* with a central circular opening 14*b*, 15*b* respectively as shown in FIG. 8. The tubular wall portions 15*a* of the seal 15 includes a vertical slit 15*c* and the seal 15 is positioned over the provision 12 to removably receive the toe portion 30*b* of the shackle 30 to permit locking or unlocking the toe portion of the shackle 30 with the locking mechanism 20. The slit 15*c* ensures snap fitting of the seal 15 with the toe portion 30*b* of the shackle 30. Central circular openings 14*b*, 15*b* of the protective seals 14, 15 have diameters slightly smaller than the diameter of the shackle 30 to provide a fit tight enough to afford an effective seal against dust, humidity, moisture and other foreign materials having ingress into the body 10 of the locking device 100. The locking device 100 is ensured with effective weather resistance with application of the protective seals 14, 15 to shield the top part of the body 10, whereas, the cover 40 prevents dust or moisture from entering the body 10 through the key slot 21. The protective seals 14, 15 and the flexible strip 16 may be produced from any desired material such as neoprene rubber, plastic etc., as a single part or multiple parts.

It is to be understood that a person of ordinary skill in the art could design the locking device 100 in any shape, dimension and configuration to produce desired components without deviating from the scope of the present disclosure. Also, various modifications and variations may be made without departing from the scope of the present invention. Therefore, it is intended that the present disclosure covers such modifications and variations provided they come within the ambit of the appended claims and their equivalents.

Advantages of the Present Disclosure

The present disclosure provides a locking device which can establish a sequence of locking or unlocking, improving workplace safety.

The present disclosure provides a locking device which can prevent others from accessing/tampering with the key slot of the locking device.

The present disclosure provides a locking device which improves safety standards, and is easy to manufacture as it has a minimum number of parts.

The present disclosure provides a locking device with an effective seal that doesn't allow entry of foreign particles into the device, therefore improving the life of the locking device.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims), are generally intended as "open" terms (e.g., the term "including" should be interpreted as "including but not limited to," the term "having" should be interpreted as "having at least," the term "includes" should be interpreted as "includes but is not limited to," etc.). It will be further understood by those skilled in the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A locking device, comprising:

a body having an inner chamber;

a locking mechanism configured within the inner chamber of the body wherein a key slot of the locking mechanism is exposed at bottom surface of the body;

a shackle comprising a heel portion moveably secured with the locking mechanism and a toe portion wherein the shackle is movable between an unlocked position and a locked position; and a cover being rotatably mounted on the bottom surface of the body, wherein the cover is rotatable between a first position and a second position wherein in the first position, the cover is adapted to close the exposed key slot to prevent access of the key slot and in the second position, the cover is adapted to expose the key slot;

the cover and body being provisioned to secure the cover in the first position by means of a secondary locking device thereby preventing the rotation of the cover from the first position to the second position, wherein a plurality of flanges extend laterally outwardly from the body and each of the flanges has a hole.

2. The locking device, as claimed in claim 1, wherein the cover comprises a plurality of holes alignable with the holes of the flanges of the body in the first position of the cover.

3. The locking device as claimed in claim 2, wherein the aligned holes are adapted to receive the secondary locking device to secure the cover in the first position.

4. The locking device as claimed in claim 3, wherein the secondary locking device is a padlock.

5. A locking device, comprising:

a body having an inner chamber;

a locking mechanism configured within the inner chamber of the body wherein a key slot of the locking mechanism is exposed at bottom surface of the body;

a shackle comprising a heel portion moveably secured with the locking mechanism and a toe portion wherein the shackle is movable between an unlocked position and a locked position; and a cover being rotatably mounted on the bottom surface of the body, wherein the cover is rotatable between a first position and a second position wherein in the first position, the cover is adapted to close the exposed key slot to prevent access of the key slot and in the second position, the cover is adapted to expose the key slot;

the cover and body being provisioned to secure the cover in the first position by means of a secondary locking device thereby preventing the rotation of the cover from the first position to the second position, wherein the cover comprises multiple portions with each of the portions being adapted to rotate relative to the other portion of the cover.

* * * * *